313-414 SR
5/14/85 OR 4,517,488

United States Patent [19]

Say

[11] Patent Number: 4,517,488

[45] Date of Patent: May 14, 1985

[54] IN-LINE ELECTRON GUN STRUCTURE FOR COLOR CATHODE RAY TUBE HAVING LENSING ELECTRODES WITH TAPERED APERTURES AND BEAM SPOT-SHAPING INSERTS

[75] Inventor: Donald L. Say, Waterloo, N.Y.

[73] Assignee: North American Philips Consumer Electronics Corp., New York, N.Y.

[21] Appl. No.: 484,780

[22] Filed: Apr. 14, 1983

[51] Int. Cl.[3] ..... H01J 29/50; H01J 29/56

[52] U.S. Cl. ..... 313/414

[58] Field of Search ..... 313/414

[56] References Cited

U.S. PATENT DOCUMENTS 4,374,342 2/1983 Say ..... 313/414

FOREIGN PATENT DOCUMENTS 13769 2/1979 Japan ..... 313/414
82548 7/1981 Japan ..... 313/414

*Primary Examiner*—Palmer Demeo
*Attorney, Agent, or Firm*—Thomas A. Briody; Jack Oisher; John C. Fox

[57] ABSTRACT

In-line electron gun structure for color cathode ray tubes in which the final focussing and accelerating electrodes each employ three in-line tapered, partially overlapping apertures in facing relationship, and at least one pair of electron beam spot-shaping inserts associated with the central aperture of the focussing electrode.

6 Claims, 9 Drawing Figures

IN-LINE ELECTRON GUN STRUCTURE FOR COLOR CATHODE RAY TUBE HAVING LENSING ELECTRODES WITH TAPERED APERTURES AND BEAM SPOT-SHAPING INSERTS

CROSS-REFERENCE TO RELATED APPLICATION

U.S. patent application Ser. No. 463,791, filed Feb. 4, 1983, describes and claims color cathode ray tube electrodes having tapered apertures, and is assigned to the assignee of the present invention. Such application is a continuation-in-part of Ser. No. 450,574, filed Dec. 16, 1982, now abandoned.

BACKGROUND OF THE INVENTION

This invention relates to an in-line electron gun structure for color cathode ray tubes (CCRT), in which the apertures of the final focusing and accelerating electrode lenses are tapered, and more particularly relates to such structures including electron beam spot-shaping inserts.

Reducing the diameter of the necks of CCRTs can lead to cost savings for the television set maker and user in enabling smaller beam deflection yokes and consequent smaller power requirements. However, reducing neck diameter while maintaining or even increasing beam deflection angle and display screen area severely taxes the performance limits of the electron gun.

In the conventional, in-line electron gun design, an electron optical system is formed by applying critically determined voltages to each of a series of spatially positioned apertured electrodes. Each electrode has at least one planar apertured surface oriented normal to the tube's long or Z axis, and containing three side-by-side or "in-line" circular straight-through apertures. The apertures of adjacent electrodes are aligned to allow passage of the three (red,blue, and green) electron beams through the gun.

As the gun is made smaller to fit in the so-called "mini-neck" tube, the apertures are also made smaller and the focusing or lensing aberrations of the apertures are increased, thus degrading the quality of the resultant picture on the display screen.

Various design approaches have been taken to attempt to increase the effective apertures of the gun electrodes. For example, U.S. Pat. No. 4,275,332, and U.S. patent application Ser. No. 303,751, filed Sept. 21, 1981 and assigned to the present assignee, describe overlapping lens structures. U.S. patent application Ser. No. 463,791, filed Feb. 4, 1983 and assigned to the present assignee, describes a "conical field focus" or CFF lens arrangement. Each of these designs is intended to increase effective apertures in the main lensing electrodes and thus to maintain or even improve gun performance in the new "mini-neck" tubes.

In the CFF arrangement, the electrode apertures have the shapes of truncated cones or hemispheres, and thus each aperture has a small opening and a related larger opening. In a preferred embodiment, the apertures are positioned so that the larger openings overlap. This overlapping eliminates portions of the sidewalls between adjacent apertures, leaving an arcuate "saddle" between these apertures.

Regardless of their complex shapes, CFF electrodes may be produced by deep drawing techniques, offering a marked cost advantage over other complex designs. However, in forming the CFF electrodes by drawing for mass production quantities, it has been discovered that the edge of the saddle between adjacent apertures becomes rounded, resulting in a slight decrease in the wall area between the apertures. Unfortunately, such a slight modification to the electrode is sufficient to distort the lensing field, and result in an out-of-round spot for the central electron beam on the display screen.

It is an object of the present invention to provide a modified electron gun structure with overlapping tapered apertures, which modified structure will compensate for the distortion in the lensing field caused by rounded saddles.

SUMMARY OF THE INVENTION

In accordance with the invention a lensing arrangement, featuring partially overlapping tapered apertures in the final focusing and accelerating electrodes of an in-line electron gun for a CCRT, is provided with electron beam spot-shaping inserts, to compensate for the distortion in the lensing field caused by rounded saddles between adjacent apertures.

Such arrangement involves the final low voltage (focusing) and high voltage (accelerating) lensing electrodes. The forward portion of the focusing electrode and the rear portion of the accelerating electrode are in adjacent, facing relationship, and each defines three partially overlapping, tapered in-line apertures, a central aperture and two side apertures. The apertures are of 3-dimensional surface of revolution (hereinafter called a volumetric configuration), which is substantially truncated, for example, a truncated cone or hemisphere, the axes of symmetry of which are parallel to one another and to the associated path of the electron beam. Each aperture has a large opening in an outer aperture plane of the electrode and a smaller opening in the interior of the electrode, the openings being separated by sloping sidewalls. A portion of the sidewall of each aperture intersects a portion of the sidewall of an adjacent aperture to form an inwardly-sloping arcuate rounded saddle along the region of intersection. The resulting structure is derived from the partial overlapping of geometric constructions of the volumetric configurations.

In order to compensate for the lensing field distortion caused by the rounded saddles, the structure also includes at least one pair of electron beam spot-shaping inserts located in mirrored, facing relationship in the region of the smaller-dimensioned opening of the central aperture of at least one of the lensing electrodes, the inserts being approximately equidistant from the axis of symmetry of the aperture.

In a preferred embodiment, a pair of inserts is located in the focussing electrode in the region of the central aperture, intersecting and symmetrical with the in-line plane of the electron gun. The inserts are preferably elongated elements having a central curved portion approximating the curvature of the rear opening, and two straight side portions which are normal to the in-line plane and separated by a distance less than the diameter of the rear opening.

In accordance with the invention, there may also be a pair of inserts associated with each of the side apertures, located above and below the in-line plane and symmetrical with it.

DESCRIPTION OF THE PREFERRED EMBODIMENTS

Figure 1:
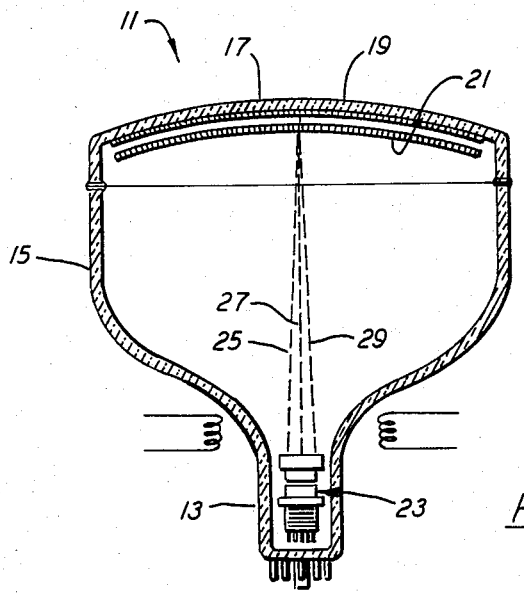
FIG. 1 is a sectioned elevation view of a color cathode ray tube wherein the invention is employed.

With reference to FIG. 1 of the drawings, there is shown a color cathode ray tube (CCRT) 11 of the type employing a plural beam in-line electron gun assembly. The envelope enclosure is comprised of an integration of neck 13, funnel 15 and face panel 17 portions. Disposed on the interior surface of the face panel is a patterned cathodoluminescent screen 19 formed as a repetitive array of color-emitting phosphor components in keeping with the state of the art. A multi-opening structure 21, such as a shadow mask, is positioned within the face panel, spaced from the patterned screen.

Encompassed within the envelope neck portion 13 is a unitized plural beam in-line electron gun assembly 23, comprised of an integration of three side-by-side gun structures. Emanating therefrom are three separate electron beams 25, 27, and 29 which are directed to pass through mask 21 and land upon screen 19. It is within this electron gun assembly 23 that the structure of the invention resides.

Figure 2:
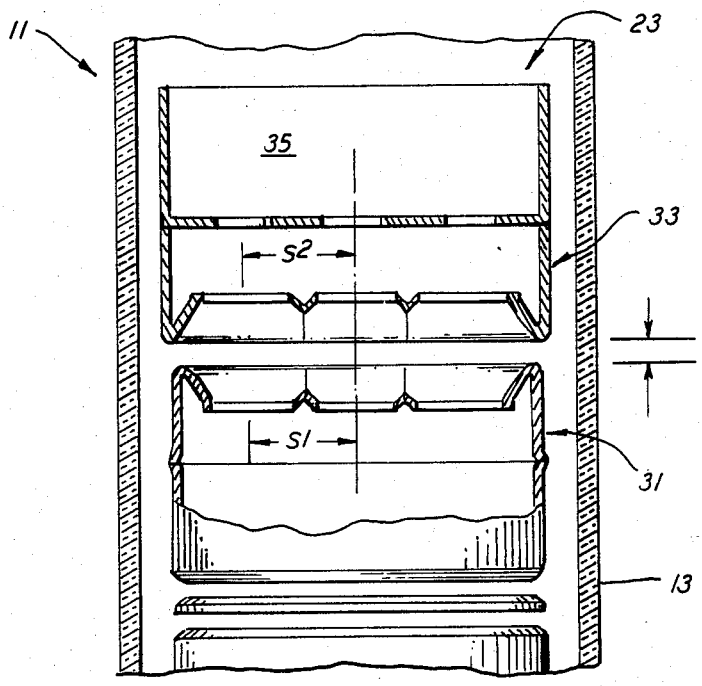
FIG. 2 is a sectioned view of the forward portion of the in-line plural beam electron gun assembly shown in FIG. 1, such view being taken along the in-line plane thereof.

Referring now to FIG. 2, the forward portion of the electron gun 23 of FIG. 1 is shown, including a low potential electrode 31, a high potential electrode 33, and a convergence cup 35. Electrode 31 is the final focusing electrode of the gun structure, and electrode 33 is the final accelerating electrode.

In a "Uni-Bi" gun typically used in mini-neck CCRTs, the main focussing electrode potential is typically 25 to 35 percent of the final accelerating electrode potential, the inter-electrode spacing is typically about 0.040 inches, the angle of taper of the apertures is about 60° with respect to the tube axis, and the aperture diameters (smaller and larger dimensioned openings) are 0.140 and 0.220 inches for the focussing electrode and 0.150 and 0.250 inches for the accelerating electrode. The spacing between aperture center is 0.177 inch ($S^1$) for the focussing electrode and 0.182 inch ($S^2$) for the accelerating electrode.

Together, these two electrodes form the final lensing fields for the electron beams. This is accomplished by cooperation between their adjacent, facing apertured portions to form lensing regions which extend across the inter-electrode space. The tapered sidewalls of the apertures enable optimum utilization of the available space inside the tube neck 13.

Figure 3:
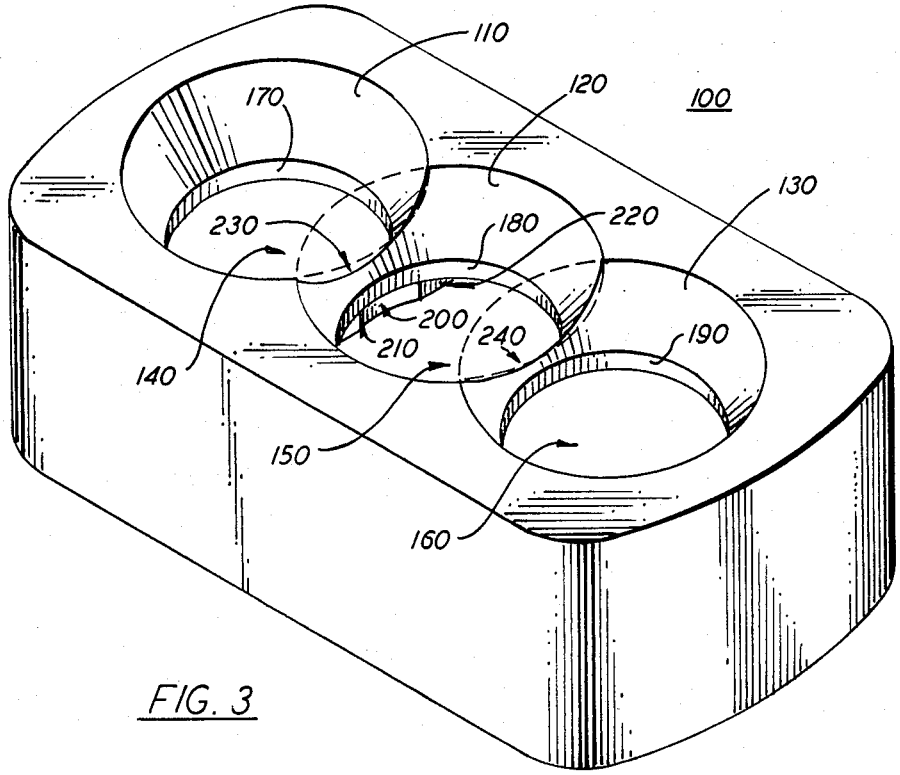
FIG. 3 is a perspective view from above of the unitized low potential lensing electrode of the gun assembly of FIG. 2, affording a partial view of the small openings of the apertures and one of the spot-shaping inserts.
Figure 4:
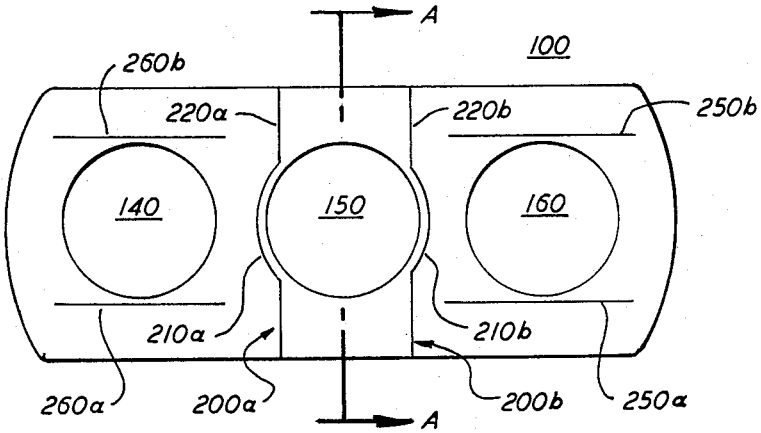
FIG. 4 is a stylized bottom view of one embodiment of the unitized low potential lensing electrode of the invention including three pairs of spot-shaping inserts.
Figure 8:
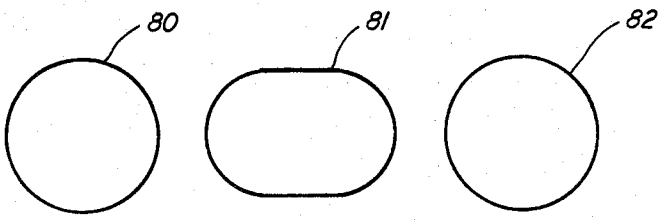
FIG. 8 is a representation of beam spot shapes related to the electron gun of FIG. 2 without spot-shaping inserts.

Referring now to FIG. 3, there is shown a focussing electrode 100 of the type shown in FIG. 2, having three in-line apertures with large front beam-exiting openings 110, 120 and 130 substantially in the forward planar surface of the electrode, and smaller rear beam-entering openings 140,150 and 160 in the interior of the electrode, such openings connected by substantially tapered sidewalls terminating with relatively short cylindrical portions 170, 180 and 190. Geometric constructions of the apertures are truncated cones (ignoring cylindrical portions 170, 180 and 190) which partially overlap one another. This overlap is indicated in phantom in the forward planar surface, and results in the partial removal of sidewall portions of adjacent apertures and the formation of inwardly sloping arcuate edges 230 and 240. In fabrication of such electrode structure by drawing, the edge tends to have a rounded contour forming what is termed herein a "saddle", resulting in reduced sidewall area between apertures and distortion of the lensing field. This field distortion results (for a typical Uni-Bi mini-neck gun as described above) in electron beam spots at the screen as shown in FIG. 8. That is, the central beam spot 81 tends to become compressed vertically and elongated in the direction of the in-line plane of the three beams. Compensation for such distortion is provided herein by beam spot-shaping inserts. A portion of one of a pair of such inserts 200 is seen in FIG. 3. A more detailed view is provided in FIG. 4, which is a bottom view of focussing electrode 100. Inserts 200*a* and 200*b* each have curved central portions 210*a* and 210*b* having a curvature conforming to that of rear opening 150. In addition, these inserts have straight side portions 220*a* and 220*b* which are parallel to each other and normal to the in-line plane. These side portions are separated by a distance less than the diameter of the opening 150. Depending upon the degree of field distortion present, and the amount of compensation desired, there may also be provided a pair of beam spot-shaping inserts for each of the side apertures 140 and 160. These are shown in FIG. 4 as elongated straight elements 250*a* and 250*b* and 260*a* and 260*b*. The inserts of each pair are parallel to each other and also to the in-line plane and are separated by a distance equal to or slightly greater than the diameter of openings 160 and 140.

Figure 5:
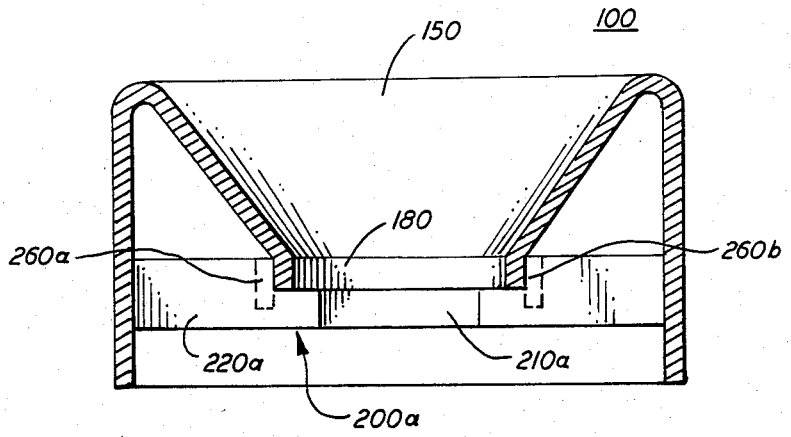
FIG. 5 is a sectioned elevational view of the embodiment of the low potential electrode of FIG. 4 taken along the plane A—A in FIG. 4.

Referring now to FIG. 5, which is a section view along plane A—A of FIG. 4, it is seen that the heights of the side aperture-related elements (260*a* and 260*b* appear in phantom) are less than the heights of central aperture related elements (200*a* shown). This height difference, as well as the greater separation between elements of the pairs, reflects the lesser amount of compensation generally needed for the side aperture-related fields than for the central aperture-related field.

Figure 6:
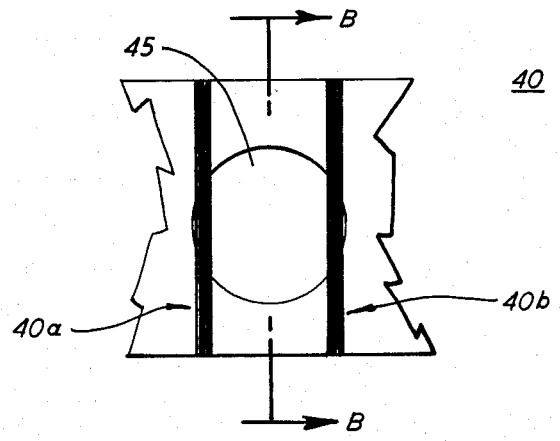
FIG. 6 is a stylized sectioned bottom view of another embodiment of the low potential electrode of the invention, including one spot-shaping inserts.
Figure 7:
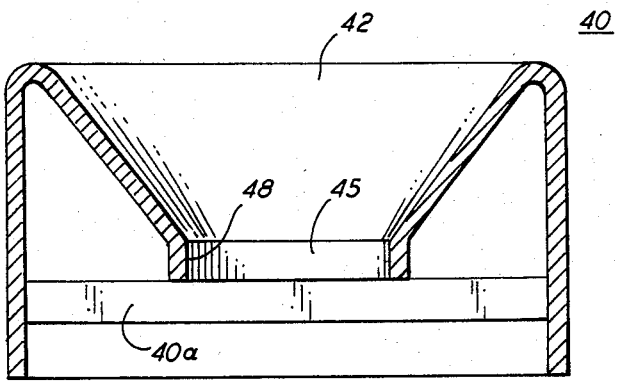
FIG. 7 is a sectioned elevation view of the embodiment of FIG. 6 taken along the plane B—B of FIG. 6.

Another embodiment of the beam spot-shaping inserts for the central aperture is shown in FIG. 6. The shaped elements of FIG. 4 have been replaced by straight elements 40*a* and 40*b*, positioned to slightly overlap the rear opening 45, providing accentuated beam spot-shaping. These inserts 40*a* and 40*b* are positioned just beyond the edge of cylindrical portion 48 of aperture 42, as shown for 40*a* in FIG. 7, a section view along plane B—B of FIG. 6. In contrast, the elements 200*a* and 200*b* are both adjacent to and extend beyond the edge of cylindrical portion 180, as shown for element 200*a* in FIG. 5.

Figure 9:
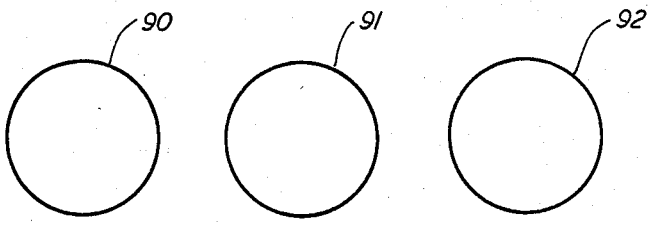
FIG. 9 is a representation of beam spot shapes related to the electron gun of FIG. 2 with spot-shaping inserts.

FIG. 9 show the beam spots after compensation by use of the inserts as described herein.

While there have been shown and described what are at present considered to be the preferred embodiment of the invention, it will be obvious to those skilled in the art that various changes and modifications may be made therein without departing from the scope of the invention as defined in the appended claims. Just as one example, the side aperture-related inserts can be curved, or U-shaped, instead of straight.

What is claimed is:

1. In an in-line electron gun structure for a color cathode ray tube, a lensing arrangement in the final focusing and accelerating electrodes comprising:

a first lensing structure in the forward portion of the focusing electrode, such structure having three in-line tapered apertures of substantially truncated volumetric configuration having substantially parallel axes of symmetry, each aperture having a front beam exit and a smalller dimensioned rear beam entrance, the entrances and exits separated by sloping sidewalls, a portion of the sidewall of each aperture intersecting with a portion of the sidewall of an adjacent aperture to form an inwardly sloping arcuate rounded saddle along the region of intersection, such structure resulting from the partial overlapping of geometric constructions of the volumetric configurations; and a second lensing structure in the rear portion of the final accelerating electrode in adjacent, facing relationship with the first structure, such second structure having three in-line tapered apertures of substantially truncated volumetric configuration having substantially parallel axes of symmetry, each aperture having a rear beam entrance and a smaller dimensioned front beam exit, the entrances and exits separated by sloping sidewalls, a portion of the sidewall of each aperture intersecting with a portion of the sidewall of an adjacent aperture to form an inwardly sloping arcuate rounded saddle along the region of intersction, such structure resulting from the partial overlapping of geometric constructions of the volumetric configurations and at least one pair of electron beam spot-shaping inserts located in facing relationship in the region of the smaller-dimensioned opening of the central aperture of at least one of said first and second lensing structures, the inserts being about equidistant from the axis of symmetry of the aperture, and separated by a distance less than the diameter of the smaller-dimensioned opening of the aperture.

2. The electron gun structure of claim 1 wherein the inserts are located in the first lensing structure, adjacent the side apertures of such structure, intersecting and symmetrical with respect to the in-line plane.

3. The electron gun structure of claim 2 wherein the inserts are elongated elements having a central curved portion approximately conforming to the curvature of the rear opening of the central aperture, and two straight side-related portions, the elements positioned so that the central portions of the inserts are adjacent to a side portions of the rear opening and the side portions of the inserts are normal to the in-line plane, parallel to one another and separated by a distance less than the diameter of the rear opening.

4. The electron gun structure of claim 2 wherein a pair of beam spot-shaping inserts are located in facing relationship in the region of the rear openings of each side aperture, the inserts being positioned above and below the in-line plane, respectively, and symmetrical therewith.

5. The electron gun structure of claim 4 in which the inserts for the side apertures are elongated straight elements, the elements being positioned parallel to each other and the in-line plane, and separated by a distance at least equal to the diameters of the rear openings.

6. The electron gun structure of claim 2 wherein the inserts for the central aperture are elongated straight elements, parallel to each other and normal to the in-line plane, and separated by a distance less than the diamter of the rear opening.

* * * * *